United States Patent [19]

Melvin et al.

[11] Patent Number: 4,679,795

[45] Date of Patent: Jul. 14, 1987

[54] OPTICAL BRIGHTENERS IN GOLF BALL COVERS

[75] Inventors: Terence Melvin, Somers, Conn.; R. Dennis Nesbitt, Westfield, Mass.

[73] Assignee: Spalding & Evenflo Companies, Inc., Tampa, Fla.

[21] Appl. No.: 861,532

[22] Filed: Apr. 18, 1986

Related U.S. Application Data

[63] Continuation-in-part of Ser. No. 519,351, Aug. 1, 1983, abandoned.

[51] Int. Cl.[4] ..... A63B 37/00; A63B 37/12

[52] U.S. Cl. ..... 273/235 R; 273/218; 273/213; 524/84; 524/100; 524/110; 524/420; 524/430; 524/432; 524/908

[58] Field of Search ..... 273/218, 235 A, 235 R; 524/908, 420, 430, 432, 84, 100, 110

[56] References Cited

U.S. PATENT DOCUMENTS

| | | | |
|---|---|---|---|
| 2,015,165 | 9/1935 | Twiss et al. | 217/235 A |
| 2,188,284 | 1/1940 | Merrill | 218/235 R |
| 2,188,285 | 1/1940 | Merrill | 218/235 R |
| 2,261,760 | 11/1941 | Habgood | 273/62 |
| 2,787,024 | 4/1957 | Smith | 273/235 R |
| 2,939,710 | 6/1960 | Dosmann et al. | 223/235 A |
| 2,997,302 | 8/1961 | Smith | 217/235 R |
| 3,313,595 | 4/1967 | Bartsch | 273/218 |
| 3,384,612 | 5/1968 | Brandt et al. | 273/218 |
| 3,502,338 | 3/1970 | Cox | 273/218 |
| 3,647,221 | 3/1972 | Holley | 273/235 A |
| 4,165,877 | 8/1979 | Miller et al. | 273/218 |

OTHER PUBLICATIONS

*The Rubber World,* "The Golf Ball–You Make it Like a Tire", May 1973, pp. 85, 86 & 181.

Raia, *Plastics World,* May 20, 1974, pp. 74 and 75.

Smith, *Rubber Age,* Sep. 1923, pp. 47–49.

Ciba-Geigy Pamphlet, "Florescent Whitening Pigments for Plastics and Coatings, A181A3M91, 1981.

*Primary Examiner*—Allan M. Lieberman

*Attorney, Agent, or Firm*—Donald R. Bahr

[57] ABSTRACT

The disclosure relates to golf balls and more particularly, to golf ball cover compositions. The disclosure is concerned primarily with composition and method for the enhancement of the color of a golf ball cover by the use of an optical brightener in conjunction with a pigmented golf ball cover composition. This invention is concerned with the enhancement of the color of white golf ball covers. When used in conjunction with a white pigmentation system, the optical brighteners in question enhance the color in the blue spectrum range in order to give the cover a whiter appearance.

28 Claims, No Drawings

OPTICAL BRIGHTENERS IN GOLF BALL COVERS

BACKGROUND

This application is a continuation-in-part application based on application Ser. No. 519,351 filed Aug. 1, 1983, now abandoned, entitled, "Optical Brighteners in Golf Ball Covers".

TECHNICAL FIELD

This invention is concerned with golf ball cover technology. In accordance with this invention, the color of the cover is enchanced by use of an optical brightener in combination with a pigment system thereby eliminating the need for a supplemental paint coating.

BACKGROUND OF THE INVENTION

Golf balls are of two types; these types being solid balls and multicomponent balls. The solid ball consists of a polymeric sphere into which is molded a plurality of dimples to aid the flight characteristic of the ball. The multicomponent balls consist of a wound or solid core which is covered with a separate and distinct cover. This invention is concerned primarily with the latter-mentioned multicomponent-type golf balls and a means for enhancing the color of the covers in question; however, the invention can be used with the solid balls as described above.

Golf ball covers have for decades consisted principally of balata, a natural resin. In the last twenty years, synthetic polymeric materials and mixtures thereof have come into widespread use as golf ball covers. With both balata covers and synthetic polymeric golf ball covers, a final multicoat paint system, including at least one pigmented coat, has been utilized in order to give the finished product a white, durable finish.

In their natural form, neither the above-mentioned balata nor synthetic polymeric materials are white in appearance. In order to provide a white substrate for the paint system as used in the prior art, it was very common to blend a white pigment into the cover composition. Regardless of this utilization of a white pigment, it was still necessary to utilize a pigmented paint system as described above in order to produce a top quality white golf ball suitable for professional play. The painting of the pigmented cover is necessary as even with the white pigment, the resulting cover is not a bright white.

With this invention, it is possible to eliminate the pigmented painting of golf balls and yet produce a golf ball which is superior to the prior art painted golf balls in both color and optical brightness.

These ends are accomplished by utilization of an optical brightener in combination with a pigmented polymeric cover system.

DESCRIPTION OF THE INVENTION

As is stated above, this invention is concerned with golf ball cover compositions. Over sixty years ago, balata came into widespread usage as a golf ball cover composition. Balata, is a natural resin, and is off white in its natural state when applied as a golf ball cover. It was soon realized that it would be desirable to have a bright white golf ball in order to enhance the aesthetics of the ball and its visibility during play. In order to achieve these ends, pigmentation of the balata golf ball cover material became common practice. While a plurality of white pigments were utilized in the early development of the golf ball, in recent years titanium dioxide became the most prevalent pigment for use in golf ball cover compositions. Regardless of the use of titanium dioxide and other pigments in golf ball cover compositions, it became apparent that a truly white golf ball could not be produced by pigmentation alone. In order to enhance the whiteness of the finished golf ball, at an early date it was decided to paint pigmented golf ball covers. To achieve the desired appearance it was necessary to utilize a multicoat paint system. This multicoat paint system is expensive and undesirable in the sense that once the paint chips during play, the ball in question becomes unsightly in that the cover material becomes visible. This cover material has a different color from the pigmented painted surface. In most instances, the cover stock material is a different shade of white as compared to the white paint. These differences in color result in an unsightly ball having a used appearance once the paint chips. The use of a multicoat paint system over a pigmented cover stock continues to date.

Starting in the mid-1960's and increasing rapidly in the early 1970's, synthetic polymeric compositions came into widespread usage as golf ball cover materials. Polyurethanes, polyethylene and ionic copolymers have been utilized as golf ball cover materials. In most instances, the synthetic polymeric materials are clear or amber color and as such, the pigmentation and painting as described above in conjunction with balata covered balls is even more important. A series of polymers, either singularly or in mixtures, as sold by the E. I. DuPont de Nemours & Co., of Wilmington, Del., under the trademark SURLYN have become particularly important as golf ball cover materials in the last decade. At the present, these surlyn resins are the most widely used cover materials for golf balls.

Typically, a golf ball cover composition consists of a synthetic or natural polymeric base to which is added a pigment in the amount of aproximately 2% as based on the weight of the polymeric material. In recent years titanium dioxide has become the most widely used pigment. In addition to the pigment, the cover composition can contain additional ingredients to retard oxidation and compositions to improve the processing characteristics of the overall mixture.

Prior to this invention, it was not possible to achieve a top-grade, white golf ball without the use of a supplemental pigmented paint system. These supplemental pigmented paint systems are very expensive and difficult to apply in that the paints themselves are expensive and they must be applied to a small spherical surface. Multicoat paint systems are commonly used which include one or more coats of a pigmented paint followed by, in many instances, clear coats.

In contrast to the prior art painted golf balls, by use of the subject invention a superior golf ball can be produced in the complete absence of a finished painted surface. This end is achieved by the use of a pigmented golf ball cover composition with an optical brightener. This combination enhances the optical appearance of the resulting cover composition in order to give it a superior white appearance. This invention may be used with clear final coatings in accordance with the discussion herein below.

Because they are cheaper and have superior processing characteristics, thermoplastic materials are generally preferred for use as cover materials in accordance with this invention. However, thermosetting resins can likewise be used in accordance with this invention. Typical, but not limitative of the properties desirable for the resin, are good flowability, moderate stiffness, high abrasion resistance, high tear strength, high resilience, and good mold release, among others. Preferred polymeric materials for use in accordance with this invention are ionic copolymers of ethylene and an unsaturated monocarboxylic acid which are available under the trademark "SURLYN" from E. I. DuPont De Nemours & Company of Wilmington, Del.

In accordance with the preferred embodiment of this invention, the cover in question is formed from zinc or sodium ionic copolymer sold by the E. I. Du Pont De Nemours Company, Inc., under the trademark "SURLYN" 1605/8940, the zinc copolymer being sold under the trademarks "SURLYN" 1557/9650, and "SURLYN" 1706/9910.

The use of singular ionic copolymers as golf ball cover stock is described in U.S. Pat. No. 3,454,280 issued July 8, 1969. The use of mixed Surlyn resins in accordance with this preferred embodiment is described in U.S. Pat. 3,819,789 issued June 25, 1974. Ionic copolymers of the type suitable for use in this invention are further described in detail in U.S. Pat. No. 3,264,272 issued Aug. 2, 1966.

To the best of the applicant's knowledge, Surlyn resins are ionic copolymers which are the sodium or zinc salts of the reaction product of an olefin having from 2 to 8 carbon atoms and an unsaturated monocarboxylic acid having from 3 to 8 carbon atoms. The carboxylic acid groups of the copolymer may be totally or partially neutralized.

This invention can likewise be used in conjunction with cellular polymeric golf ball covers as are described in U.S. Pat. No. 4,274,637 issued June 23, 1981.

In addition to the above-described preferred Surlyn resins, natural polymeric materials may be used in accordance with this invention. Balata and gutta percha are examples of natural polymeric materials adapted for use in accordance with this invention.

The range of synthetic polymeric materials which can be used in accordance with this invention, other than the above-described Surlyn resins, is much broader than the range of natural materials. Suitable homopolymeric and copolymer materials which may be adapted for use in this invention are as follows:

(1) Vinyl resins formed by the polymerization of vinyl chloride, or by the copolymerization of vinyl chloride with vinyl acetate, acrylic esters and vinylidene chloride;

(2) Polyolefins such as polyethylene, polypropylene, polybutylene and copolymers such as polyethylene methylacrylate, polyethylene ethylacrylate, polyethylene vinyl acetate, polyethylene methacrylic or acrylic acid or polypropylene acrylic acid, polypropylene/EPDM grafted with acrylic acid as sold under the trademark "Polybond" by Reichhold Chemicals, Inc., Hackettstown, N.J. 07840, or anhydride modified polyolefins as sold under the trademark "Plexar" by Northern Petrochemical Company, Rolling Meadows, IL 60008.

(3) Polyurethanes, such as are prepared from polyols and diisocyanates or polyisocyanates;

(4) Polyamides such as poly (hexamethylene adipamide) and others prepared from diamines and dibasic acids, as well as those from amino acids such as poly (caprolactam), and blends of polyamides with Surlyn, polyethylene, ethylene copolymers, EPDM, etc.

(5) Acrylic resins as exemplified by the copolymers of methylmethacrylate, acrylonitrile, styrene, maleic anhydride, etc. and blends of these resins with poly vinyl chloride, elastomers, etc.

(6) Thermoplastic rubbers such as the urethanes, olefinic thermoplastic rubbers such as blends of polyolefins with EPDM, block copolymers of styrene and butadiene, or isoprene or ethylene-butylene rubber, polyether block amides, an example of such a product is sold under the trademark "Pebax" by Rilsan Industrial, Inc., Birdsboro, PA 19508;

(7) Polyphenylene oxide resins, or blends of polyphenylene oxide with high impact polystyrene as sold under the trademark "Noryl" by General Electric Company, Pittsfield, MA.

(8) Thermoplastic polyesters, such as PET, PBT, PETG and elastomers sold under the trademarks "Hytrel" by E. I. DuPonte de Nemours & Company of Wilmington, Del. and "Lomod" by the General Electric Company of Pittsbield, MA.

(9) Blends and alloys including polycarbonate with ABS, PBT, PET, SMA, PE, elastomers, etc. and PVC with ABS or EVA or other elastomers. Blends of thermoplastic rubbers with polyethylene, polypropylene, polyacetal, nylon, polyesters, cellulose esters, etc.

In the above description shorthand symbols are used to describe certain polymers. The symbols used and their description are as follows:

| | |
|---|---|
| ABS | Acrylonitrile butadiene styrene |
| PBT | Polybutylene terephthalate |
| PET | polyethylene terephthalate |
| SMA | Styrene maleic anhydride |
| PE | Polyethylene |
| PETG | Polyethylene terephthalate/glycol modified |
| EPDM | Ethyl-propylene-non-conjugated diene terpolymer |
| PVC | Polyvinyl chloride |
| EVA | Ethylene vinyl acetate |

The above list is not meant to be limiting or exhaustive, but merely illustrates the wide range of polymeric materials which may be employed in the present invention. Mixtures of the above-described materials may also be used.

It is within the purview of this invention to add to the cover compositions of this invention compatible materials which do not affect the basic novel characteristics of the composition of this invention. Among such materials are antioxidants, antistatic agents, and stabilizers.

As can be seen from the discussion above, the subject invention can be used in conjunction with a wide variety of polymeric materials which are suitable for the formation of covers.

The white basic color of the golf ball cover is formed by the pigmentation of one of the above-mentioned polymeric materials. Suitable pigments for use in accordance with this invention include the following: titanium dioxide, zinc oxide, and zinc sulfide.

The amount of pigment used in conjunction with the polymeric cover composition naturally depends on the particular polymeric material utilized and the particular pigment utilized. The concentration of the pigment in the polymeric cover composition can be from about 1% to about 10% as based on the weight of the polymeric material. A more preferred range is from about 1% to about 5% as based on the weight of the polymeric material. The most preferred range is from about 1% to about 3% as based on the weight of the polymeric material.

The most preferred cover compositions for use in accordance with this invention are the Surlyn resins as are described above. The most preferred pigment for use in accordance with this invention is titanium dioxide. When this combination of components is utilized, it is preferred that the concentration of titanium dioxide in the cover composition be from about 1% to about 10% as based on the weight of Surlyn resin utilized. A more preferred range for the concentration of titanium dioxide is from about 1% to about 5% as based on the Surlyn resin utilized. A most preferred concentration for the titanium dioxide is about 2% as based on the weight of the Surlyn resin utilized.

The subject invention is adapted to utilize a wide variety of optical brighteners.

One skilled in the art must choose an optical brightener which is compatible with the polymer used as a base cover stock and with the pigment used therein. In that optical brighteners have been utilized for a wide variety of purposes in many different environments for many years, non-functional optical brighteners exist. Opitcal brighteners have been commercially utilized for the brightening of textiles in order to impart a desireable blue-white appearance. The applicant does not understand fully the ramifications of why some opitcal brighteners are functional while other optical brighteners are not functional. It is within the purview of one skilled in the art to select a functional optical brightener for use in accordance with this invention. The data of examples 33 through 39 listed herein below illustrate a non-functional optical brightener. These examples utilize Leucopure BS as sold by Sandoz, East Hanover, N.J. 07936. Leucopure BS is commercially utilized in the textile art. As can be seen from the data of examples 33 through 39, Leucopure BS does not function in accordance with this invention. While the applicant does not understand fully the reasons for the non-functionality of Leucopure BS, it is thought Leucopure BS may be decomposing under the severe processing conditions necessary to form golf ball covers and hence in the finished golf ball cover there is effectively no optical brightener present.

Examples of suitable optical brighteners which can be used in accordance with this invention are Uvitex OB as sold by the Ciba-Geigy Chemical Company, Ardsley, N.Y. Uvitex OB is thought to be 2,5-Bis(5-tert-butyl-2-benzoxazolyl)thiophene. Examples of other optical brighteners suitable for use in accordance with this invention are as follows: Leucopure EGM as sold by Sandoz, East Hanover, N.J. 07936. Leucopure EGM is thought to be 7-(2h-naphthol (1,2-d)-triazol-2-yl)-3-phenyl-coumarin. Phorwhite K-2002 as sold by Mobay Chemical Corporation, P.O. Box 385, Union Metro Park, Union, N.J. 07083 is thought to be a pyrazoline derivative. Eastobrite OB-1 as sold by Eastman Chemical Products Inc., Kingsport, TN, is thought to be 4,4'-Bis(2-benzoxazolyl)stilbene.

Many optical brighteners are colored. The percentage of optical brighteners utilized must not be excessive in order to prevent the optical brightener from functioning as a pigment or dye in its own right.

The above-mentioned Uvitex OB and Estobrite OB-1 are preferred optical brighteners for use in accordance with this invention.

The percentage of optical brightener which can be used in accordance with this invention is from about 0.01% to about 0.5% as based on the weight of the polymer used as a cover stock. A more preferred range is from about 0.05% to about 0.25%, with the most preferred range being from about 0.05% to about 0.1%. It is understood that the above ranges must be adjusted depending on the optical properties of the particular optical brightener used and the polymeric environment in which it is used.

A most preferred cover composition for use in accordance with this invention consists of 46.31 parts of sodium ionic copolymer, as sold under the trademark "SURLYN" 1605/8940, 7.38 parts of a zinc ionic copolymer as sold under the trademark "SURLYN" 1557/9650, 46.31 parts of a zinc ionic coplymer as sold under the trademark "SURLYN" 1706/9910, 2.3% of titanium dioxide, 0.102% of Uvitex OB and 0.012% of Ultramarine Blue. The percentages of titanium dioxide and Uvitex OB are based on the combined weight of sodium and zinc ionic copolymers.

Covers for use in accordance with this invention can be injection molded onto a prepositioned core in accordance with injection molding techniques commonly known in the prior art. Likewise, covers on finished golf balls can be produced by injection molding cover half shells, two of which are then positioned around a golf ball core. The core with the preformed half shells thereon is then positioned in a compression mold and two half shells are fused together and dimples formed thereon in accordance with procedures commonly known in the prior art.

As has been amply discussed above, the subject invention can utilize a wide variety of polymers. When pigmented, many of the polymers in question and in particular Surlyn resins, are not glossy after injection molding. Experience has demonstrated that the average golfer prefers a glossy golf ball. In order to produce glossy golf balls, the balls of this invention may be coated with a clear epoxy-urethane system subsequent to molding. The system in question consists of a clear epoxy primer, followed by a clear urethane coat. Use of this clear coat system subsequent to the molding operation is not mandatory in order to achieve the desirable results of this invention; however, it is highly desirable. In addition to high initial gloss, the above-mentioned system produces a golf ball which is durable and maintains its gloss during play. It is understood by one skilled in the art that other clear coat systems can likewise be utilized.

One qualification for the optical brightener which is used in accordance with this invention is the optical brightener in question must be compatible with the polymer system utilized and it must be stable at temperatures necessary for the injection molding the golf ball cover onto a prepositioned core. This qualification is necessary if the abovedescribed injection molding technique is utilized. If the compression molding technique is used in the formation of the ball, the optical brightener used in accordance with this invention must be stable at the temperature necessary for the injection molding of the half shell and the compression molding of the half shells around a preformed core.

The subject invention is useful in producing white golf balls wherein the whiteness of the ball is observed through a clear coat finish. It should be noted that this invention is likewise very useful in that it can provide a superior substrate if it is deemed to be desirable to paint the golf ball in a conventional manner with a white pigmented paint system. This procedure is advantageous in this instance in that a base of maximum whiteness is provided for the paint coating. Painting of a surface is desirable in situations where as a result of foreign matter the resulting finished golf ball must be painted. In the trade this is generally referred to as a dirty manufacturing process wherein impurities sometimes appear in the resulting finished product in such a manner that the overall appearance of the finished golf ball is cosmetically detrimentally affected. These slight cosmetic defects can be hidden by using a single coat of white paint over the optically brightened surface of this invention in place of the more standard two coats of white paint. In this manner the cosmetic defects are hidden and a truly superior product is produced.

One skilled in the art is aware of the fact that there are various hues of the color white; for example, there are blue whites, yellow whites, etc. In accordance with the preferred embodiment of this invention, trace amounts of a blue pigment are added to the golf ball cover composition in order to give said cover composition materials a blue white appearance. Naturally, it is understood if other hues of the color white were desired, different pigments can be added to the cover composition material. The amount of pigment used must be adjusted by one skilled in the art in order to achieve the desired color here.

In the subject specification and claims, the term "center" is utilized to define the central part of the finished golf ball. As used in this specification and claims the term "center" refers to both solid centers as are used on two-piece golf balls, and to wound centers which are commonly used in balls which are referred to in the trade as three-piece golf balls.

Lastly, it should be noted that the technology of the subject invention has outstanding environmental advantages. As has been discussed above, with this invention the painting can be eliminated altogether or it can be minimized. With modern environmental restrictions, the painting of any product entails severe environmental problems. In many instances the environmental safeguards repesent a significant part of the painting cost. Since painting can be eliminated or minimized, these safeguards can likewise be eliminated or minimized. Elimination of these environmental problems by the practice of the subject invention represents a significant advantage of the subject invention.

EXAMPLES

Finished golf balls were prepared for the below listed examples by positioning preformed, cross-linked polybutadiene cores in an injection molding cavity. The cores in question were centrally positioned in the cavities by the use of retractable pins. The cover was the injection molded around the core.

In these examples wherein TCL paints are utilized, these paints are sold by Technical Coatings Labs of Avon, CT.

Wherever Sanncor paints are used, these paints are the product of Sanncor Industries, Inc., Leominster, MA.

The Guardsman paints are sold by Guardsman Chemical, Inc., Grand Rapids, MI 49507.

The whiteness index tests were conducted in accordance with ASTM E-313-73. The yellowness index tests were conducted in accordance with ASTM D-1925-70, using a Hunter Lab Model D 25 optical sensor. The reflectance was also measured in accordance with ASTM E-313-73.

In all examples, the cover composition formulas are on a parts by weight basis. The Surlyn resins as used in these examples are a product of the E. I. DuPont de Nemours & Co., Inc. in accordance with the description herein above.

Texin 480AR is a thermoplastic urethane resin as sold by Mobay Chemical Corporation, Pittsburg, Pa. 15205.

Irgonox 110 is an antioxidant as sold by Ciba-Geigy whose address is given herein above.

Andrez 8000 AE is a styrene polymer sold by Anderson Development Co., Aerian, Mich.

Omega Blue NCNF is sold by Select Color Products, 60 Park Avenue, Randolph, N.J. 07869.

BASF Blue L 6930 is sold by BASF Wyandotte Corp., 100 Cherry Hill Road, Parsippany, N.J. 07054.

EXAMPLE 1

Using the procedures described above, twelve golf balls were prepared wherein the cover had the following composition:

| | |
|---|---|
| Surlyn 1605/8940 | 46.31 |
| Surlyn 1706/9910 | 46.31 |
| Surlyn 1557/9650 | 7.38 |
| Titanium dioxide | 2.34 |
| Ultramarine Blue | .012 |
| Uvitex OB | .102 |

The resulting golf ball was removed from the injection mold cavity. The balls had a white appearance and when tested using a Hunter-Lab Colorimeter gave the following average values:

| | |
|---|---|
| Reflectance: | 83.21 |
| Whiteness Index: | 141.18 |
| Yellowness Index: | −20.25 |

The Uvitex OB is a product of the Ciba-Geigy Chemical Company in accordance with the description herein above.

Ultramarine Blue is a pigment dye as sold by Whitaker, Clark and Daniels, of South Plainsfield, N.J.

EXAMPLE 2

The procedure described in Example 1 was repeated except that the balls were finished conventionally with a commercial two-coat, clear finish as follows:

| |
|---|
| 1st coat - clear epoxy TCL 3631/3707 - .055 gm/ball dry weight |
| 2nd coat - clear urethane TCL 2119/2061 - .070 gm/ball dry weight |

The average optical properties for these balls were:

| | |
|---|---|
| Reflectance: | 81.32 |
| Whiteness Index: | 113.97 |
| Yellowness Index: | −12.78 |

EXAMPLE 3

Sample slabs of golf ball material were formed and tested in accordance with the procedure described in Example 1, wherein the sample slabs had the following composition:

| | |
|---|---|
| Surlyn 1605/8940 | 46.31 |
| Surlyn 1706/9910 | 46.31 |
| Surlyn 1557/9650 | 7.38 |
| Titanium dioxide | 2.34 |

-continued

| | |
|---|---|
| Ultramarine Blue | .012 |
| Phorwhite K-2002 | .102 |

The resulting slabs had a white appearance. Visual examination of the samples indicated that the optical properties of the samples were similar to those of the golf ball covers of Example 1. Phorwhite K-2002 is sold by the Mobay Chemical Corporation in accordance with the description herein above.

EXAMPLE 4

Sample slabs of golf ball cover material were again formed and tested in accordance with the procedure described in Example 3, wherein the cover had the following composition:

| | |
|---|---|
| Surlyn 1605/8940 | 46.31 |
| Surlyn 1706/9910 | 46.31 |
| Surlyn 1557/9650 | 7.38 |
| Titanium dioxide | 2.34 |
| Ultramarine Blue | .012 |
| Leucopure EGM | .102 |

Again, the resulting sample slabs had a white appearance and had optical properties which were similar to the golf ball covers of Example 1. Leucopure EGM is sold by Sandoz in accordance with the description herein above.

EXAMPLE 5

Twelve balls were again formed and tested in accordance with the procedure described in Example 1, wherein the cover had the following composition:

| | |
|---|---|
| Surlyn 1605/8940 | 46.31 |
| Surlyn 1706/9910 | 46.31 |
| Surlyn 1557/9650 | 7.38 |
| Titanium dioxide | 1.81 |
| Ultramarine Blue | .012 |

The resulting golf ball was removed from the injection mold cavity, and was painted in accordance with the following procedure:

One coat TCL Epoxy Primer 2259-A & B - 150 mg./ball (wet weight) was applied, followed by One coat TCL White Urethane 3225/2061 - 150 mg./ball (wet weight) followed by:

One coat TCL Clear Urethane 2119/2061 - 70 mg./ball (wet weight) The balls had a white appearance and had the following average optical properties:

| | |
|---|---|
| Reflectance: | 76.04 |
| Whiteness Index: | 103.53 |
| Yellowness Index: | −10.28 |

Golf balls as manufactured in accordance with this example have been sold by the applicant.

EXAMPLE 6

Using the procedure of Example 1, three additional golf balls were produced wherein the cover material had the following composition:

| | |
|---|---|
| Texin 480AR | 80.0 |

-continued

| | |
|---|---|
| Surlyn 1702/9970 | 20.0 |
| TiO2 | 5.0 |
| Ultra Blue | 0.02 |
| Uvitex OB | 0.10 |
| Irgonox 110 | 0.17 |
| Acrowax C | 2.0 |

After injection molding, the balls were coated with one coat of TCL clear urethane 2119/2061, approximately 70 mg/ball dry weight.

The balls had a white appearance and had the following average optical properties:

| | |
|---|---|
| Reflectance: | 82.27 |
| Whiteness Index: | 108.95 |
| Yellowness Index: | −10.11 |

EXAMPLE 7

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 84.94 |
| Whiteness Index: | 120.25 |
| Yellowness Index: | −12.40 |

EXAMPLE 8

Using the procedure of Example 1, three additional golf balls were produced wherein the cover material had the following composition:

| | |
|---|---|
| Surlyn 1557/9650 | 50.0 |
| Surlyn 1555/8660 | 50.0 |
| TiO2 | 2.352 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 83.3 |
| Whiteness Index: | 123.25 |
| Yellowness Index: | −13.89 |

EXAMPLE 9

Using the procedure of Example 1, three additional golf balls were produced wherein the cover material had the following composition:

| | |
|---|---|
| Surlyn 1559/8528 | 100.0 |
| TiO2 | 2.352 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 84.65 |
| Whiteness Index: | 117.25 |
| Yellowness Index: | −11.34 |

EXAMPLE 10

Using the procedure of Example 1, three additional golf balls were produced wherein the cover material had the following composition:

| | |
|---|---|
| Surlyn 1557/9650 | 100.0 |
| TiO2 | 2.352 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 83.77 |
| Whiteness Index: | 114.60 |
| Yellowness Index: | −11.14 |

EXAMPLE 11

Using the procedure of Example 1, three additional golf balls were produced wherein the cover material had the following composition:

| | |
|---|---|
| Surlyn 1706/9910 | 45.0 |
| Surlyn 1702/9970 | 15.0 |
| Surlyn 1707/8920 | 40.0 |
| TiO2 | 2.352 |
| Ultra Blue | 0.012 |

-continued

| | |
|---|---|
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 84.26 |
| Whiteness Index: | 127.27 |
| Yellowness Index: | −14.66 |

EXAMPLE 12

Using the procedure of Example 1, three additional golf balls were produced wherein the cover material had the following composition:

| | |
|---|---|
| Texin 480AR | 100.0 |
| TiO2 | 5.0 |
| Ultra Blue | 0.02 |
| Uvitex OB | 0.10 |
| Irgonox 110 | 0.17 |
| Acrowax C | 2.0 |

After injection molding, the balls were coated with one coat of TCL clear urethane 2119/2061, approximately 70 mg/ball dry weight.

The balls had a white appearance and had the following average optical properties:

| | |
|---|---|
| Reflectance: | 82.89 |
| Whiteness Index: | 87.17 |
| Yellowness Index: | −2.36 |

EXAMPLE 13

Using the procedure of Example 1, three additional golf balls were produced wherein the cover material had the following composition:

| | |
|---|---|
| Synthetic Transpolyisoprene | 70.0 |
| Andrez 8000 AE | 30.0 |
| TiO2 | 2.352 |
| Ultra Blue | 0.012 |

After injection molding, the balls were coated with a two part clear coat which consisted of one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 79.93 |
| Whiteness Index: | 65.89 |
| Yellowness Index: | −4.48 |

EXAMPLE 14

Using the procedure of Example 1, three additional golf balls were produced wherein the cover material had the following composition:

| | |
|---|---|
| Synthetic Transpolyisoprene | 70.0 |
| Andrez 8000 AE | 30.0 |
| TiO2 | 2.352 |
| Ultra Blue | 0.012 |
| Uvitex OB | 0.051 |

After injection molding, the balls were coated with a two part clear coat which consisted of one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 80.14 |
| Whiteness Index: | 78.84 |
| Yellowness Index: | 0.31 |

EXAMPLE 15

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Estobrite OB-1 | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximtely 70 mg/ball dry weight.

The balls had a white appearance and had the following average optical properties:

| | |
|---|---|
| Reflectance: | 85.49 |
| Whiteness Index: | 131.20 |
| Yellowness Index: | −15.31 |

EXAMPLE 16

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Estobrite OB-1 | 0.5 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had the following average optical properties:

| | |
|---|---|
| Reflectance: | 83.88 |
| Whiteness Index: | 48.43 |
| Yellowness Index: | +6.43 |

EXAMPLE 17

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Estobrite OB-1 | 0.25 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had the following average optical properties:

| | |
|---|---|
| Reflectance: | 83.83 |
| Whiteness Index: | 89.57 |
| Yellowness Index: | −5.15 |

EXAMPLE 18

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Estobrite OB-1 | 0.100 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 83.58 |
| Whiteness Index: | 118.97 |
| Yellowness Index: | −13.07 |

EXAMPLE 19

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Estobrite OB-1 | 0.010 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 84.38 |
| Whiteness Index: | 116.18 |
| Yellowness Index: | −10.99 |

EXAMPLE 20

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Estobrite OB-1 | 0.001 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 83.20 |
| Whiteness Index: | 110.85 |
| Yellowness Index: | −9.87 |

EXAMPLE 21

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Phorwhite K2002 | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 84.04 |
| Whiteness Index: | 121.68 |
| Yellowness Index: | −13.05 |

EXAMPLE 22

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Phorwhite K2002 | 0.5 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 82.76 |
| Whiteness Index: | 116.14 |
| Yellowness Index: | −12.15 |

EXAMPLE 23

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Phorwhite K2002 | 0.25 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 83.27 |
| Whiteness Index: | 118.52 |
| Yellowness Index: | −12.15 |

EXAMPLE 24

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Phorwhite K2002 | 0.10 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 83.58 |
| Whiteness Index: | 112.09 |
| Yellowness Index: | −10.36 |

EXAMPLE 25

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Phorwhite K2002 | 0.010 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 83.06 |
| Whiteness Index: | 109.32 |
| Yellowness Index: | −9.58 |

EXAMPLE 26

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Phorwhite K2002 | 0.001 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 83.57 |
| Whiteness Index: | 105.51 |
| Yellowness Index: | −8.06 |

EXAMPLE 27

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Leucopure EGM | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 83.54 |
| Whiteness Index: | 109.49 |
| Yellowness Index: | −9.57 |

EXAMPLE 28

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Leucopure EGM | 0.5 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had the following average optical properties:

| | |
|---|---|
| Reflectance: | 84.65 |
| Whiteness Index: | 40.48 |
| Yellowness Index: | +8.18 |

EXAMPLE 29

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Leucopure EGM | 0.25 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had the following average optical properties:

| | |
|---|---|
| Reflectance: | 84.38 |
| Whiteness Index: | 74.69 |
| Yellowness Index: | −1.25 |

EXAMPLE 30

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Leucopure EGM | 0.100 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 84.78 |
| Whiteness Index: | 122.58 |
| Yellowness Index: | −13.79 |

EXAMPLE 31

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Leucopure EGM | 0.010 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 84.12 |
| Whiteness Index: | 118.60 |
| Yellowness Index: | −12.11 |

EXAMPLE 32

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Leucopure EGM | 0.001 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 83.93 |
| Whiteness Index: | 119.65 |
| Yellowness Index: | −12.37 |

EXAMPLE 33

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Leucopure BS | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 83.23 |
| Whiteness Index: | 100.61 |
| Yellowness Index: | −6.72 |

EXAMPLE 34

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Leucopure BS | 0.50 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 84.98 |
| Whiteness Index: | 88.25 |
| Yellowness Index: | −3.21 |

EXAMPLE 35

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Leucopure BS | 0.250 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 83.64 |
| Whiteness Index: | 95.28 |
| Yellowness Index: | −5.74 |

EXAMPLE 36

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Leucopure BS | 0.100 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 84.42 |
| Whiteness Index: | 101.12 |
| Yellowness Index: | −6.99 |

EXAMPLE 37

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Leucopure BS | 0.010 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 84.47 |
| Whiteness Index: | 103.91 |
| Yellowness Index: | −7.39 |

EXAMPLE 38

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Leucopure BS | 0.001 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 84.04 |
| Whiteness Index: | 107.13 |
| Yellowness Index: | −8.62 |

EXAMPLE 39

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9850 | 7.42 |
| TiO2 | 2.352 |
| Ultra Blue | 0.012 |
| Uvitex OB | 0.5 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 85.19 |
| Whiteness Index: | 135.23 |
| Yellowness Index: | −17.78 |

EXAMPLE 40

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Uvitex OB | 0.25 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 85.30 |
| Whiteness Index: | 138.06 |
| Yellowness Index: | −18.28 |

EXAMPLE 41

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Uvitex OB | 0.100 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 84.33 |
| Whiteness Index: | 135.83 |
| Yellowness Index: | −17.76 |

EXAMPLE 42

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Uvitex OB | 0.010 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 83.70 |
| Whiteness Index: | 121.27 |
| Yellowness Index: | −13.29 |

EXAMPLE 43

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Uvitex OB | 0.001 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 84.28 |
| Whiteness Index: | 112.61 |
| Yellowness Index: | −9.82 |

EXAMPLE 44

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 83.2 |
| Whiteness Index: | 112.51 |
| Yellowness Index: | −10.84 |

EXAMPLE 45

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 10.0 |
| Ultra Blue | 0.012 |
| Uvitex OB | 0.051tz,1/32 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 89.84 |
| Whiteness Index: | 108.31 |
| Yellowness Index: | −6.07 |

EXAMPLE 46

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.5 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 87.99 |
| Whiteness Index: | 114.37 |
| Yellowness Index: | −8.99 |

EXAMPLE 47

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9850 | 7.42 |
| TiO2 | 2.5 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 84.33 |
| Whiteness Index: | 118.39 |
| Yellowness Index: | −11.87 |

EXAMPLE 48

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9850 | 7.42 |
| $TiO_2$ | 1.0 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 78.72 |
| Whiteness Index: | 119.39 |
| Yellowness Index: | −15.48 |

EXAMPLE 49

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| $TiO_2$ | 0.5 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 74.50 |
| Whiteness Index: | 124.31 |
| Yellowness Index: | −20.03 |

EXAMPLE 50

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| ZnO | 2.352 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had the following average optical properties:

| | |
|---|---|
| Reflectance: | 65.64 |
| Whiteness index: | 126.26 |
| Yellowness Index | −27.57 |

EXAMPLE 51

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| ZnO | 2.0 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had the following average optical properties:

| | |
|---|---|
| Reflectance: | 62.59 |
| Whiteness Index: | 124.72 |
| Yellowness Index: | −29.45 |

EXAMPLE 52

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| ZnO | 1.0 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 56.56 |
| Whiteness Index: | 107.87 |
| Yellowness Index: | −26.38 |

EXAMPLE 53

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| ZnO | 0.5 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had the following average optical properties:

| | |
|---|---|
| Reflectance: | 54.55 |
| Whiteness Index: | 93.55 |
| Yellowness Index: | −20.20 |

EXAMPLE 54

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| Zinc Sulfide | 2.352 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 81.31 |
| Whiteness Index: | 128.15 |
| Yellowness Index: | −16.98 |

EXAMPLE 55

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| Zinc Sulfide | 10.0 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 87.50 |
| Whiteness Index: | 119.22 |
| Yellowness Index: | −10.81 |

EXAMPLE 56

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| Zinc Sulfide | 5.0 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties;

| | |
|---|---|
| Reflectance: | 85.48 |
| Whiteness Index: | 126.16 |
| Yellowness Index: | −14.07 |

EXAMPLE 57

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| Zinc Sulfide | 2.0 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 80.85 |
| Whiteness Index: | 132.47 |
| Yellowness Index: | −18.95 |

EXAMPLE 58

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| Zinc Sulfide | 1.0 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 74.61 |
| Whiteness Index: | 131.59 |
| Yellowness Index: | −22.67 |

EXAMPLE 59

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| Zinc Sulfide | 0.5 |
| Ultra Blue | 0.012 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had the following average optical properties:

| | |
|---|---|
| Reflectance: | 67.51 |
| Whiteness Index: | 125.06 |
| Yellowness Index: | −25.29 |

EXAMPLE 60

Using the procedure of Example 1, three additional golf balls were produced wherein the cover material had the following composition:

| | |
|---|---|
| Texin 480AR | 100.0 |
| TiO2 | 5.0 |
| Omega Blue 152 | 0.006 |
| Uvitex OB | 0.10 |
| Irgonox 110 | 0.17 |
| Acrowax C | 2.00 |

After injection molding, the balls were coated with one coat of TCL clear urethane 2119/2061, approximately 70 mg/ball dry weight.

The balls had a blue appearance and had the following average optical properties:

| | |
|---|---|
| Reflectance: | 67.48 |
| Whiteness Index: | 132.71 |
| Yellowness Index: | −35.55 |

EXAMPLE 61

Using the procedure of Example 1, three additional golf balls were produced wherein the cover material had the following composition:

| | |
|---|---|
| Texin 480AR | 80.0 |
| Surlyn 1702/9970 | 20.0 |
| TiO2 | 5.0 |
| Omega Blue 152 | 0.006 |
| Uvitex OB | 0.10 |
| Irgonox 110 | 0.17 |
| Acrowax C | 2.0 |

After injection molding, the balls were coated with one coat of TCL clear urethane 2119/2061, approximately 70 mg/ball dry weight.

The balls had a blue appearance and had the following average optical properties:

| | |
|---|---|
| Reflectance: | 73.40 |
| Whiteness Index: | 125.97 |
| Yellowness Index: | −28.26 |

EXAMPLE 62

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| Unitane | 2.352 |
| Omega Blue 152 | 0.0014 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a blue white appearance and had the following average optical properties:

| | |
|---|---|
| Reflectance: | 83.11 |
| Whiteness Index: | 123.72 |
| Yellowness Index: | −18.77 |

EXAMPLE 63

Using the procedure of Example 1, three additional golf balls were produced wherein the cover material had the following composition:

| | |
|---|---|
| Texin 480AR | 100.0 |
| TiO2 | 5.0 |
| BASF Blue L 6930 | .004 |
| Uvitex OB | 0.10 |
| Irgonox 110 | 0.17 |
| Acrowax C | 2.0 |

After injection molding, the balls were coated with one coat of TCL clear urethane 2119/2061, aproximately 70 mg/ball dry weight.

The balls had a blue appearance and had the following average optical properties:

| | |
|---|---|
| Reflectance: | 68.09 |
| Whiteness Index: | 128.84 |
| Yellowness Index: | −33.00 |

EXAMPLE 64

Using the procedure of Example 1, three additional golf balls were produced wherein the cover material had the following composition:

| | |
|---|---|
| Texin 480AR | 80.0 |
| Surlyn 1702/9970 | 20.0 |
| TiO2 | 5.0 |
| BASF Blue L 6930 | 0.004 |

-continued

| | |
|---|---|
| Uvitex OB | 0.10 |
| Irgonox 110 | 0.17 |
| Acrowax C | 2.0 |

After injection molding, the balls were coated with one coat of TCL clear urethane 2119/2061, approximately 70 mg/ball dry weight.

The balls had a blue appearance and had the following average optical properties:

| | |
|---|---|
| Reflectance: | 75.25 |
| Whiteness Index: | 124.14 |
| Yellowness Index: | −25.16 |

EXAMPLE 65

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| BASF Blue L 6930 | 0.0014 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a blue appearance and had the following average optical properties:

| | |
|---|---|
| Reflectance: | 82.58 |
| Whiteness Index: | 126.33 |
| Yellowness Index: | −20.89 |

EXAMPLE 66

Using the procedure of Example 1, three additional golf balls were produced wherein the cover material had the following composition:

| | |
|---|---|
| Texin 480AR | 100.0 |
| TiO2 | 5.0 |
| Uvitex OB | 0.10 |
| Irgonox 110 | 0.17 |
| Acrowax C | 2.0 |

After injection molding, the balls were coated with one coat of TCL clear urethane 2119/2061, approximately 70 mg/ball dry weight.

The balls had a white appearance and had the following average optical properties:

| | |
|---|---|
| Reflectance: | 86.35 |
| Whiteness Index: | 89.42 |
| Yellowness Index: | −0.32 |

EXAMPLE 67

Using the procedure of Example 1, three additional golf balls were produced wherein the cover material had the following composition:

| | |
|---|---|
| Texin 480AR | 80.0 |
| Surlyn 1702/9970 | 20.0 |
| TiO2 | 5.0 |
| Uvitex OB | 0.10 |
| Irgonox 110 | 0.17 |
| Acrowax C | 2.0 |

After injection molding, the balls were coated with one coat of TCL clear urethane 2119/2061, approximately 70 mg/ball dry weight.

The balls had a white appearance and had the following average optical properties:

| | |
|---|---|
| Reflectance: | 87.90 |
| Whiteness Index: | 88.84 |
| Yellowness Index: | +0.45 |

EXAMPLE 68

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Uvitex OB | 0.051 |

After injection molding, the balls were coated with a two part clear coat which consisted on one coat Guardsman Waterborne Primer 45-1036, approximately 60 mg/ball dry weight, followed by one coat TCL clear urethane 2119/2061, approximately 70 mg/ball dry weight.

The balls had a white appearance and had the following average optical properties:

| | |
|---|---|
| Reflectance: | 93.81 |
| Whiteness Index: | 102.59 |
| Yellowness Index: | −4.08 |

EXAMPLE 69

Using the procedure of Example 1, three additional golf balls were produced wherein the cover material had the following composition:

| | |
|---|---|
| Surlyn 1605/8940 | 46.29 |
| Surlyn 1706/9910 | 46.29 |
| Surlyn 1557/9650 | 7.42 |
| TiO2 | 2.352 |
| Ultra Blue | 0.012 |
| Uvitex OB | 0.051 |

After injection molding, the balls were coated with a two part clear coat which consisted on one coat Sanncor Primer EXPA 964 approximately 60 mg/ball dry weight, followed by one coat Sanncor clear urethane EXPA 972, approximately 70 mg/ball dry weight.

The balls had a white appearance and had the following average optical properties:

| | |
|---|---|
| Reflectance: | 83.90 |
| Whiteness Index: | 126.21 |
| Yellowness Index: | −14.90 |

DISCUSSION OF THE EXAMPLES

It can be seen that by utilization of the subject invention when comparing Examples 1, 2, 3, and 4, a superior golf ball and sample slabs are produced when the procedure of this invention as described in these Examples is utilized. It should be noted that in addition to enhancing the Reflectance, Whiteness Index, and Yellowness Index, the golf balls produced in accordance with Examples 1, 2, 3, and 4 can be formed at a substantial cost saving when compared to the prior art golf balls; i.e., the golf balls produced in accordance with Examples 1, 2, 3, and 4 have superior optical properties as compared to the prior art golf balls as per Example 5 and Table I. However, the balls produced in accordance with Examples 1, 2, 3, and 4 are significantly cheaper to manufacture in that the expensive white paint system has been eliminated.

The date of Examples 6 through 12 and 14 demonstrate that the subject invention is functional with a wide variety of different cover blend formulations. Example 13 is a control in that the composition does not contain an optical brightener. Examples 15 through 38 demonstrate that this invention can utilize a variety of different optical brighteners.

The data for Examples 16 and 17 illustrates a situation wherein the amount of optical brightener utilized is excessive and as such a negative result is achieved. It should be noted that in Examples 16 and 17 the yellowness index increased which is highly undesirable. This increase in the yellowness index indicates that the balls had a yellow cast. The optical brightener utilized, Estobrite OB-1, is yellow. Because of the excess amount of the optical brightener utilized, the optical brightener functioned as a pigment or dye in its own right. In contrast, when one observes the data for example 18, wherein the amount of optical brightener is decreased, the yellowness index decreases in order to produce a finished golf ball which does not have a yellow cast.

The data of Examples 39 through 43 demonstrate that a preferred optical brightener, UVITEX OB, can be utilized at different concentrations. Example 44 is a control in that the composition of this example does not utilize an optical brightener.

Examples 45 through 49 illustrate the functionality of Titanium Dioxide at different concentrations in the subject invention.

From an analysis of the data of Examples 45 through 59, it can be seen that the reflectance whiteness and yellowness index varies with the percentage of the pigment utilized and with the particular pigment utilized. One skilled in the art has to adjust the percentage of the pigment utilized in order that a golf ball having desirable optical properties is produced in accordance with this invention. In arriving at the amount of pigment utilized, one skilled in the art must consider the negative optical properties of the particular pigment. In this regard, it should be particularly noted that in higher percentages as is illustrated in the data for Examples 45 and 46, titanium dioxide tends to impart a yellow cast to the resulting golf ball.

Examples 50 through 53 further illustrate that Zinc Oxide can be utilized at different concentrations.

The data of Examples 54 through 59 show that zinc sulfide can be used as a pigment in different concentrations.

Examples 60 through 68 illustrate that various blue pigments can be utilized in different percentages. These examples further illustrate that if too much blue pigment is utilized, the resulting golf ball has a distinct bluish tinge as compared to a blue-white color. This is undesirable as the best color for a golf ball is a blue-white cover which the human eye perceives as a bright white and not a golf ball having a distinct bluish tinge. In Examples 60 through 65 an excess amount of blue pigment was utilized resulting in golf ball covers which had a distinct bluish cast. The correct amount of blue pigment is exemplified by the data of Examples 6 and 7.

Lastly, the data of Example 69 illustrates that different finish systems can be utilized to produce golf balls having superior optical properties.

Because the golf balls of this invention as per the above Examples are brighter or, in other words, have a whiter appearance, the balls of this invention are more saleable when compared to the prior art balls. In a white golf ball, it is desirable to have the Reflectance number as high as possible, the Whiteness Index as high as possible, and the Yellowness Index as low as possible.

Table I compares the balls of the invention with a plurality of prior art golf balls. As can be seen, the balls of this invention have better optical properties when compared to those prior art balls. To the best of the applicant's knowledge, the prior art balls of Table I were painted in accordance with conventional procedures.

TABLE I

| | | REFLECTANCE | WHITENESS INDEX | YELLOWNESS INDEX |
|---|---|---|---|---|
| 1 | Top-Flite Ball of Example 5 | 76.04 | 103.53 | −10.28 |
| 2 | Titleist Pro-Trajectory | 76.03 | 83.38 | −2.44 |
| 3 | Acushnet Pinnacle | 78.18 | 91.59 | −5.11 |
| 4 | Hogan Apex S | 79.42 | 91.80 | −3.27 |
| 5 | Wilson Aviator | 78.45 | 85.88 | −2.19 |
| 6 | MacGregor MT Tourney | 75.50 | 81.74 | −2.14 |
| 7 | Dunlop Maxfli | 75.72 | 101.11 | −9.25 |
| | Ball of Example 1 | 83.21 | 141.18 | −20.25 |
| | Ball of Example 2 | 81.32 | 113.97 | −12.78 |

Ball No. 1 was sold in the past by Spalding Division of Questor Corporation.
Balls No. 2 and 3 are sold by the Acushnet Company, New Bedford, MA.
Ball No. 4 is sold by the AMF Ben Hogan Golf Co., Fort Worth, TX.
Ball No. 5 is sold by the Wilson Sporting Goods Co. of RiverGrove, IL.
Ball No. 6 is sold by the MacGregor Golf Co. of Atlanta, GA.
Ball No. 7 is sold by Dunlop Sports Co. of Greenville, SC.

What is claimed is:

1. A golf ball which incorporates a polymeric material which contains from about one percent 1% to about ten percent 10% of a white pigment wherein said pigmented polymeric material incorporates from about 0.01 to about 0.50 percent of a compatible optical brightener which increases the whiteness of the surface of said golf ball all percentages to total 100 percent.

2. The golf ball of claim 1 wherein said ball has essentially a uniform cross section.

3. The golf ball of claim 1 wherein said ball has a wound or solid center and a cover.

4. The golf ball of claim 1 wherein said surface is formed from a polymeric material selected from the group consisting of polyurethane resins, polyolefin resins and ionic copolymers which are the metal salts of the reaction product of an olefin having from 2 to 8 carbon atoms and an unsaturated monocarboxylic acid having from 3 to 8 carbon atoms.

5. A golf ball having a core and a cover wherein said cover comprises from about 99 to about 89.50 percent of a natural or synthetic polymer, from about one to about ten percent of a white pigment and from about 0.05 to about 0.25 percent of a compatible optical brightener which increases the whiteness of the cover all percentages to total 100 percent.

6. A golf ball having a core and a cover wherein said cover comprises from about 99 to about 94.80 percent of a natural or synthetic polymer, from about 1 to about 5 percent of a white pigment and from about 0.05 to about 0.25 percent of a compatible optical brightener which increases the whiteness of the cover all percentages to total 100 percent.

7. A golf ball having a core and a cover wherein said cover comprises from about 99 to about 96.90 percent of a natural or synthetic polymer, from about 1 to about 3 percent of a white pigment and from about 0.05 to about 0.10 percent of a compatible optical brightener which increases the whiteness of the cover all percentages to total 100 percent.

8. A golf ball having a core and a cover wherein said cover comprises about 97.9 percent of a natural or synthetic polymer, about 2 percent of a white pigment and from about 0.05 to about 0.10 percent of a compatible optical brightener which increases the whiteness of the cover all percentages to total 100 percent.

9. The golf ball of claim 5 wherein said cover is formed from a polymeric material selected from the group consisting of polyurethane resins, polyolefin resins, ionic copolymers which are metal salts of the reaction product of an olefin having from 3 to 8 carbon atoms and an unsaturated monocarboxylic acid having from 2 to 8 carbon atoms and mixtures of said polymers.

10. The golf ball of claim 6 wherein said cover is formed from a polymeric material selected from the group consisting of polyurethane resins, polyolefin resins, ionic copolymers which are metal salts of the reaction product of an olefin having from 2 to 8 carbon atoms and an unsaturated monocarboxylic acid having from 3 to 8 carbon atoms and mixtures of said polymers.

11. The golf ball of claim 7 wherein said cover is formed from a polymeric material selected from the group consisting of polyurethane resins, polyolefin resins, ionic copolymers which are metal salts of the reaction product of an olefin having from 2 to 8 carbon atoms and an unsaturated monocarboxylic acid having from 3 to 8 carbon atoms and mixtures of said polymers.

12. The golf ball of claim 8 wherein said cover is formed from a polymeric material selected from the group consisting of polyurethane resins, polyolefin resins, ionic copolymers which are metal salts of the reaction product of an olefin having from 2 to 8 carbon atoms and an unsaturated monocarboxylic acid having from 3 to 8 carbon atoms and mixtures of said polymers.

13. The golf ball of claim 5 wherein said cover is formed from a member selected from the group consisting of ionic copolymers which are the sodium salt of the reaction product of an olefin having from 2 to 8 carbon atoms and an unsaturated monocarboxylic acid having from 3 to 8 carbon atoms and the zinc salt of the reaction product of an olefin having from 2 to 8 carbon atoms and an unsaturated monocarboxylic acid having from 3 to 8 carbon atoms.

14. The golf ball of claim 6 wherein said cover is formed from a member selected from the group consisting of ionic copolymers which are the sodium salt of the reaction product of an olefin having from 2 to 8 carbon atoms and an unsaturated monocarboxylic acid having from 3 to 8 carbon atoms and the zinc salt of the reaction product of an olefin having from 2 to 8 carbon atoms and an unsaturated monocarboxylic acid having from 3 to 8 carbon atoms.

15. The golf ball of claim 7 wherein said cover is formed from a member selected from the group consisting of ionic copolymers which are the sodium salt of the reaction product of an olefin having from 2 to 8 carbon atoms and an unsaturated monocarboxylic acid having from 3 to 8 carbon atoms and the zinc salt of the reaction product of an olefin having from 2 to 8 carbon atoms and an unsaturated monocarboxyic acid having from 2 to 8 carbon atoms.

16. The golf ball of claim 8 wherein said cover is formed from a member selected from the group consisting of ionic copolymers which are the sodium salt of the reaction product of an olefin having from 2 to 8 carbon atoms and an unsaturated monocarboxylic acid having from 3 to 8 carbon atoms and the zinc salt of the reaction product of an olefin having from 2 to 8 carbon atoms and an unsaturated monocarboxylic acid having from 3 to 8 carbon atoms.

17. The golf ball of claim 5 wherein said cover is formed from a mixture of ionic copolymers selected from the group consisting of ionic copolymers which are the sodium salt of the reaction product of an olefin having from 2 to 8 carbon atoms and an unsaturated monocarboxylic acid having from 3 to 8 carbon atoms and the zinc salt of the reaction product of an olefin having from 2 to 8 carbon atoms and an unsaturated monocarboxylic acid having from 3 to 8 carbon atoms.

18. The golf ball of claim 6 wherein said cover is formed from a mixture of ionic copolymers selected from the group consisting of ionic copolymers which are the sodium salt of the reaction product of an olefin having from 2 to 8 carbon atoms and an unsaturated monocarboxylic acid having from 3 to 8 carbon atoms and the zinc salt of the reaction product of an olefin having from 2 to 8 carbon atoms and an unsaturated monocarboxylic acid having from 3 to 8 carbon atoms.

19. The golf ball of claim 7 wherein said cover is formed from a mixture of ionic copolymers selected from the group consisting of ionic copolymers which are the sodium salt of the reaction product of an olefin having from 2 to 8 carbon atoms and an unsaturated monocarboxylic acid having from 3 to 8 carbon atoms and the zinc salt of the reaction product of an olefin having from 2 to 8 carbon atoms and an unsaturated monocarboxylic acid having from 3 to 8 carbon atoms.

20. The golf ball of claim 8 wherein said cover is formed from a mixture of ionic copolymers selected from the group consisting of ionic copolymers which are the sodium salt of the reaction product of an olefin having from 2 to 8 carbon atoms and an unsaturated monocarboxylic acid having from 3 to 8 carbon atoms and the zinc salt of the reaction product of an olefin having from 2 to 8 carbon atoms and an unsaturated monocarboxylic acid having from 3 to 8 carbon atoms.

21. A golf ball having a center and cover wherein said cover comprises from about 99 to about 89.50 percent of a member selected from the group consisting of ionic copolymers which are the sodium salt of the reaction product of an olefin having from 2 to 8 carbon atoms and an unsaturated monocarboxylic acid having from 2 to 8 carbon atoms and the zinc salt of the reaction product of an olefin having from 2 to 8 carbon atoms and an unsaturated monocarboxylic acid having from 3 to 8 carbon atoms, from about 1 to about 10 percent of a white pigment which is a member selected from the group consisting of titanium dioxide, zinc oxide, and zinc sulfide, a trace amount of a blue pigment, and from about 0.01 to about 0.50 percent of an optical brightener which is a member selected from the group consisting of 2,5-Bis(5-tert-butyl-2-benzoxazolyl)thiophene, 4,4'-Bis(2-benzoxazolyl)stilbene, and 7-(2h-naphthol(1,2-d)-triazol-2-yl)-3-phenyl-coumarin all percentages to total 100 percent.

22. A golf ball having a center and cover wherein said cover comprises from about 99 to about 94.80 percent of a member selected from the group consisting of ionic copolymers which are the sodium salt of the reaction product of an olefin having from 2 to 8 carbon atoms and an unsaturated monocarboxylic acid having from 3 to 8 carbon atoms and the zinc salt of the reaction product of olefin having from 3 to 8 carbon atoms and an unsaturated monocarboxylic acid having from 2 to 8 carbon atoms, from about 1 to about 5 percent of a white pigment which is a member selected from the group consisting of titanium dioxide, zinc oxide, zinc sulfide, a trace amount of a blue pigment, and from about 0.05 to about 0.25 percent of an optical brightener which is a member selected from the group consisting of 2,5-Bis(5-tert-butyl-2-benzoxazolyl)thiophene, 4,4'-Bis(2-benzoxazolyl)stilbene, and 7-(2h-naphthol(1,2-d)-triazol-2-yl)-3-phenyl-coumarin all percentages to total 100 percent.

23. A golf ball having a center and cover wherein said cover comprises from about 99 to about 96.90 percent of a member selected from the group consisting of ionic copolymers which are the sodium salt of the reaction product of an olefin having from 2 to 8 carbon atoms and an unsaturated monocarboxylic acid having from 3 to 8 carbon atoms and the zinc salt of the reaction product of an olefin having from 2 to 8 carbon atoms and an unsaturated monocarboxylic acid having from 3 to 8 carbon atoms, from about 1 to about 3 percent of a white pigment which is a member selected from the group consisting of titanium dioxide, zinc oxide, and zinc sulfide, a trace amount of a blue pigment, and from about 0.05 to about 0.10 percent of an optical brightener which is a member selected from the group consisting of 2,5-Bis(5-tert-butyl-2-benzoxazolyl)thiophene, 4,4'-Bis(2-benzoxazolyl)stilbene, and 7-(2h-naphthol(1,2-d)-triazol-2-yl)-3-phenyl-coumarin all percentages to total 100 percent.

24. A golf ball having a center and cover wherein said cover comprises about 97.9 percent of a member selected from the group consisting of ionic copolymers which are the sodium salt of the reaction product of an olefin having from 2 to 8 carbon atoms and an unsaturated monocarboxylic acid having from 3 to 8 carbon atoms and the zinc salt of the reaction product of olefin having from 2 to 8 carbon atoms and an unsaturated monocarboxylic acid having from 3 to 8 carbon atoms, about 2 percent of a pigment which is a member selected from the group consisting of titanium dioxide, zinc oxide, and zinc sulfide, and from about 0.05 to about 0.10 percent of an optical brightener which is a member selected from the group consisting of 2,5-Bis(5-tert-butyl-2-benzoxazolyl)thiophene, 4,4'-Bis(2-benzoxazolyl)stilbene, and 7-(2h-naphthol(1,2-d)-triazol-2-yl)-3-phenyl-coumarin all percentages to total 100 percent.

25. A golf ball having a center and cover wherein said cover comprises from about 99 to about 89.50 percent of a mixture of ionic copolymers which are the sodium salt of the reaction product of an olefin having from 2 to 8 carbon atoms and an unsaturated monocarboxylic acid having from 3 to 8 carbon atoms and the zinc salt of the reaction product of an olefin having from 2 to 8 carbon atoms and an unsaturated monocarboxylic acid having from 3 to 8 carbon atoms, about 1 to about 10 percent of a white pigment which is a member selected from the group consisting of titanium dioxide, zinc oxide, and zinc sulfide, a trace amount of a blue pigment and from about 0.01 to about 0.50 percent of an optical brightener which is a member selected from the group consisting of 2,5-Bis(5-tert-butyl-2-benzoxazolyl)thiophene, 4,4'-Bis(2-benzoxazolyl)stilbene, and 7-(2h-naphthol(1,2-d)-ytriazol-2-yl)-3-phenyl-coumarin all percentages to total 100 percent.

26. A golf ball having a center and cover wherein said cover comprises from about 99 to 94.80 percent of a mixture of ionic copolymers which are the sodium salt of the reaction product of an olefin having from 2 to 8 carbon atoms and an unsaturated monocarboxylic acid having from 3 to 8 carbon atoms and the zinc salt of the reaction product of an olefin having from 2 to 8 carbon atoms and an unsaturated monocarboxylic acid having from 2 to 8 carbon atoms, from about 1 to about 5 percent of a white pigment which is a member selected from the group consisting of titanium dioxide, zinc oxide, and zinc sulfide, a trace amount of a blue pigment and from about 0.05 to 0.25 percent of an optical brightener which is a member selected from the group consisting of 2,5-Bis(5-tert-butyl-2-benzoxazolyl)thiophene, 4,4'-Bis(2-benzoxazolyl)stilbene, and 7-(2h-naphthol(1,2-d)-triazol-2-yl)-3-phenyl-coumarin all percentages to total 100 percent.

27. A golf ball having a center and cover wherein said cover comprises from about 99 to about 96.90 percent of a mixture of ionic copolymers which are the sodium salt of the reaction product of an olefin having from 2 to 8 carbon atoms and an unsaturated monocarboxylic acid having from 3 to 8 carbon atoms and the zinc salt of the reaction product of an olefin having from 2 to 8 carbon atoms and an unsaturated monocarboxylic acid having from 3 to 8 carbon atoms, from about 1 to about 3 percent of a white pigment which is a member selected from the group consisting of titanium dioxide, zinc oxide, and zinc sulfide, a trace amount of blue pigment and from about 0.05 to about 0.25 percent of an optical brightener which is a member selected from the group consisting of 2,5-Bis(5-tert-butyl-2-benzoxazolyl)thiophene, 4,4'-Bis(2-benzoxazolyl)stilbene, and 7-(2h-naphthol(1,2-d)-triazol-2-yl)-3-phenyl-coumarin all percentages to total 100 percent.

28. A golf ball having a center and cover wherein said cover comprises about 97.0 percent of a mixture of ionic copolymers which are the sodium salt of the reaction product of an olefin having from 2 to 8 carbon atoms and an unsaturated monocarboxylic acid having from 3 to 8 carbon atoms and the zinc salt of the reaction product of an olefin having from 2 to 8 carbon atoms and an unsaturated monocarboxylic acid having from 3 to 8 carbon atoms, about 2 percent of a white pigment which is a member selected from the group consisting of titanium dioxide and zinc sulfide, a trace amount of blue pigment, and about 0.05 percent of 4,4'-Bis(2-benzoxazolyl)stilbene all percentages to total 100 percent.

* * * * *